United States Patent [19]

Plambeck et al.

[11] 4,026,544

[45] May 31, 1977

[54] BURNING LOGS SIMULATOR

[76] Inventors: H. Robert Plambeck, 106 Cavo Drive; H. Robert Plambeck, III, 18 Kimball Drive, both of Poughkeepsie, N.Y. 12603

[22] Filed: May 5, 1976

[21] Appl. No.: 683,297

[52] U.S. Cl. ..... 272/14; 40/106.53; 46/232; 272/15

[51] Int. Cl.[2] ..... A63J 5/00

[58] Field of Search ..... 272/15, 14, 8 F; 46/DIG. 1, 232, 52, 98, 111, 112, 174, 175 R, 14; 40/106.52, 106.51, 106.53, 106.54, 28.1, 138, 139, 132 F, 132 H; 128/DIG. 15

[56] References Cited

UNITED STATES PATENTS

| | | | |
|---|---|---|---|
| 68,467 | 9/1867 | Tanner | 272/15 |
| 1,131,151 | 3/1915 | McCormick | 272/15 |
| 1,804,595 | 5/1931 | Curtiss | 40/106.53 |
| 3,120,717 | 2/1964 | Glass et al. | 46/232 X |
| 3,120,718 | 2/1964 | Glass et al. | 272/14 X |
| 3,174,243 | 3/1965 | Green | 40/139 |
| 3,304,640 | 2/1967 | Swartz | 40/106.54 |
| 3,499,239 | 3/1970 | Mungo | 40/106.53 |
| 3,603,013 | 9/1971 | Reed | 40/106.54 |
| 3,699,697 | 10/1972 | Painton | 40/106.53 |

*Primary Examiner*—Richard C. Pinkham
*Assistant Examiner*—Arnold W. Kramer
*Attorney, Agent, or Firm*—Joseph L. Spiegel

[57] ABSTRACT

A burning logs simulator comprises a burning logs replica illuminated internally and presenting to a front viewer or user the appearance of a pile of burning logs. Curtains of mechanically agitated flicker strips are located behind the front of the replica with a light source therebetween and produce flickering imparting a sensation of a fast burning, hot fire throughout the face of the burning logs. The noise or sounds of such a fire are simulated by the moving interaction of two pieces of material, one piece having looped fibers and the other having hooked fibers.

11 Claims, 8 Drawing Figures

BURNING LOGS SIMULATOR

FIELD OF THE INVENTION

This invention relates to devices that simulate a pile of burning logs both visually and aurally. In particular, it relates to improvements in such devices.

DESCRIPTION OF THE PRIOR ART

Burning log simulators are devices designed to be placed primarily in a fireplace to simulate a pile of logs burning therein. These devices are generally of two types, gas operated and electrically operated. The former involves the use of a combustible gas, such as natural gas or propane, which is burned in or near a simulated non-combustible pile of logs. Because gas burns without the sounds of hissing and crackling that normally accompany an actual pile of burning logs, such devices are either silent or include a noise simulator. Examples of such devices are disclosed in U.S. Pat. No. 3,543,741—Whitehead; and, 3,723,046—Poling, et al.

The electrical type generally comprises a log replica having a translucent colored portion illuminated from within the replica to create for the user a visual simulation of the colors and brilliancy of a fire. The devices may include additional means to simulate the flicker of the flames and the noises of burning logs. Quite obviously, such electrical devices are operated without any combustion. Examples of such devices are disclosed in U.S. Pat. Nos. 3,499,239—Mungo; and, 3,526,984—Nielsen et al.

The instant invention is directed primarily to improvements in burning log simulators of the electrical type.

As is known and obvious, a pile of burning logs produces unique and variable sensations dependent upon the type of logs, how the logs are stacked, the age of the fire, the rate of combustion, etc. Most of the commercially available simulators are intended to represent only one state, i.e., a specific type of log burning at a fixed rate and in a limited area of the face of the logs. Thus, simulators generally differ dependent on representing primarily different types of logs mostly simulating a normal, uniform fire in a limited area with a rhythmic motion and small flames. The instant invention is directed to a device for simulating a hissing, snapping fast flickering hot fire with various size flames throughout the entire face of the logs.

SUMMARY OF THE INVENTION

One of the objects of the invention is to provide an improved burning log simulator for producing unique aural and visual sensations simulating conditions of a pile of real burning logs.

Another object is to provide a burning log simulator that is cheap to produce, requires little or no maintenance and is reliable in operation.

Still another object is such a simulator characterized by various size flames throughout the entire face of the logs in a non-rhythmic or sporadic manner.

A further object is to provide simple and inexpensive means to simulate the flicker and noises of a fire.

Other objects and advantages of the invention will be apparent from the following description taken in connection with the accompanying drawing wherein.

DETAILED DESCRIPTION

Figure 1:
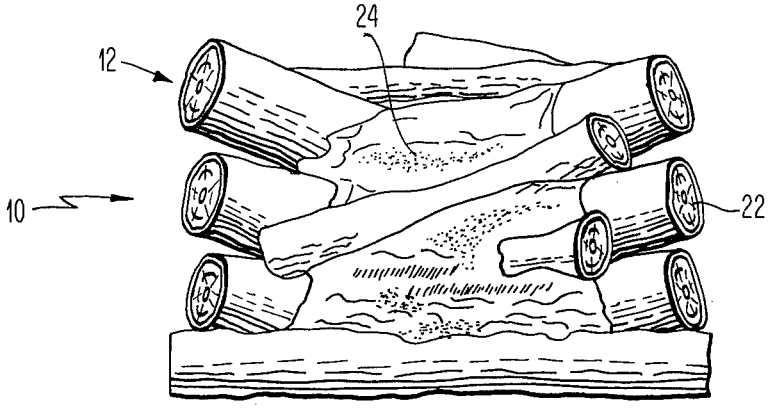
FIG. 1 is a front elevational view of a preferred embodiment of the invention.

Referring now to the drawing, a burning log simulator 10 comprises a burning log replica 12, a frame 14, an electric light 16, a noise simulator 18 and a flicker simulator 20.

As shown in FIG. 1, replica 12 is of conventional construction and includes solid portion 22 shaped like a pile of logs that are in the process of being burned, and a translucent light-transmitting central portion 24. Portion 22 may be formed from real logs that are cut to shape, or from suitable plastic or ceramic materials and secured together in any conventional manner. When made of real logs, the logs provide the "smell" of wood that might add to the enjoyment of the simulator.

Portion 24 is typically made of clear translucent plastic having a non-uniform surface shadowed black with white highlights to give a charring effect. Portion 24 diffuses light such that objects therebehind are not directly visible but light reflected from such objects can be seen.

Figure 2:
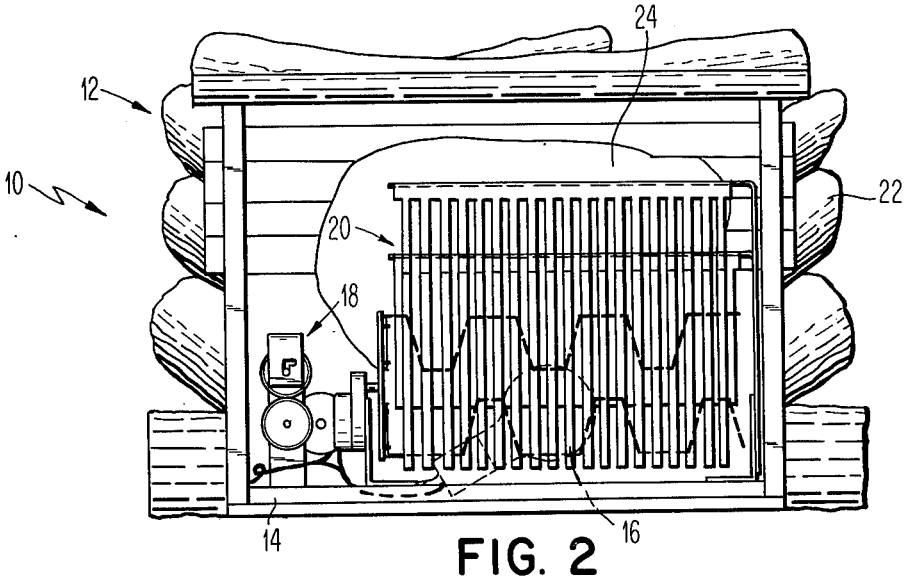
FIG. 2 is a rear elevational view of the invention shown in FIG. 1, with a back plate removed.
Figure 3:
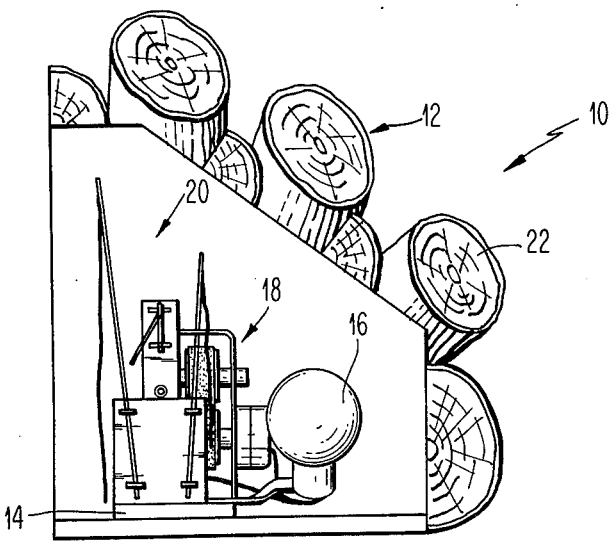
FIG. 3 is a side elevational view of the embodiment shown in FIG. 1, with a side plate removed to expose the interior.
Figure 4:
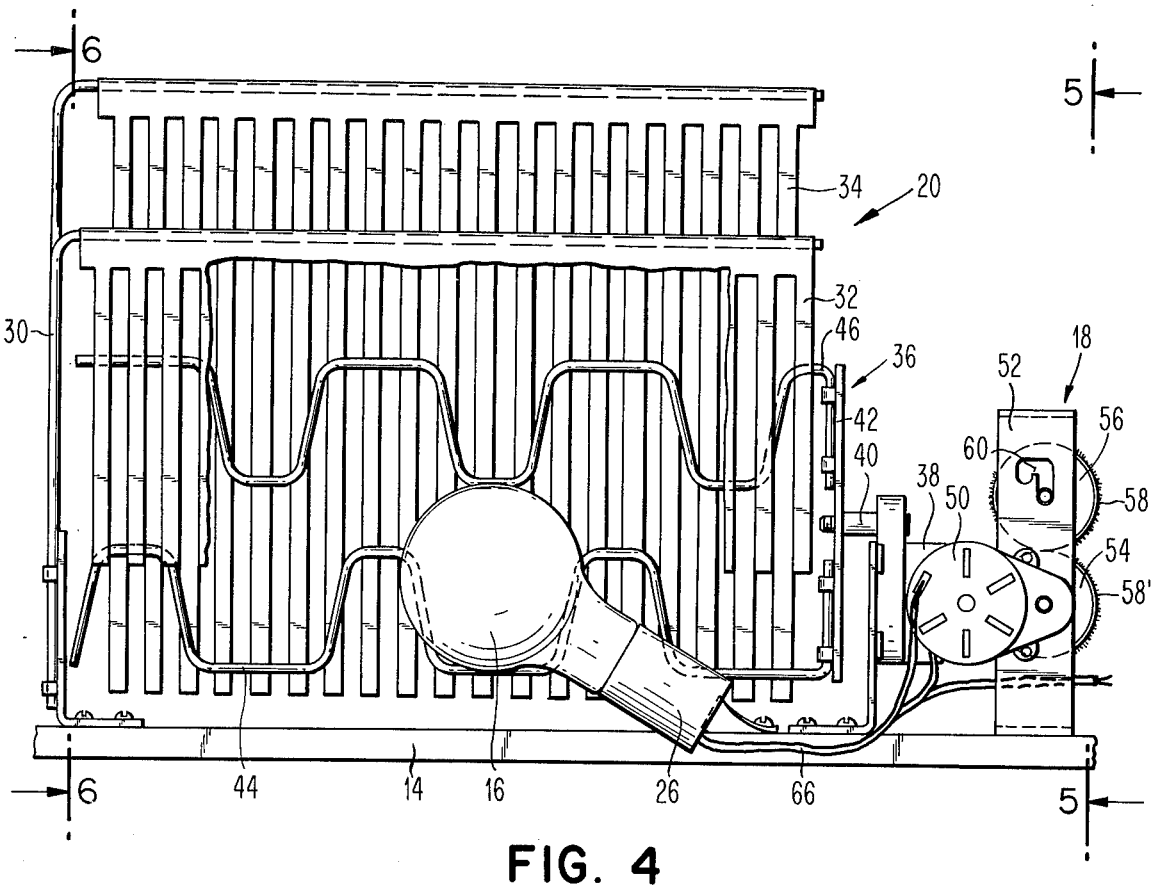
FIG. 4 is an enlarged, rear elevational view, with portions removed, of details shown in FIG. 1.
Figure 5:
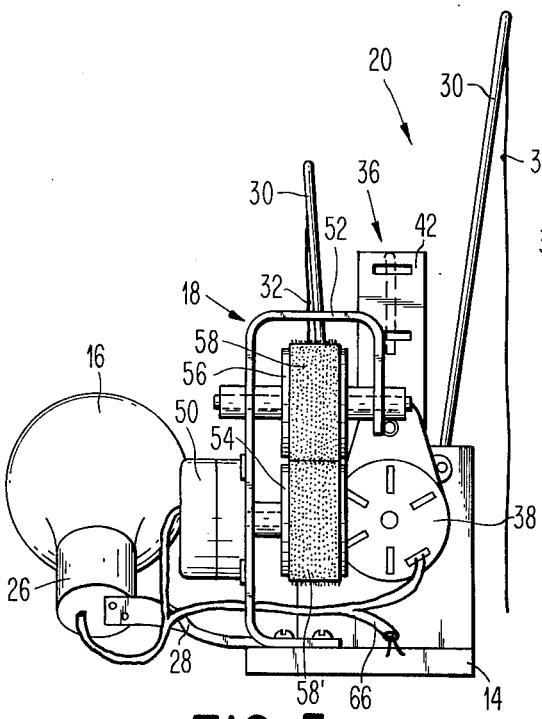
FIG. 5 is an enlarged detail view taken along reference line 5—5 of FIG. 4.
Figure 6:
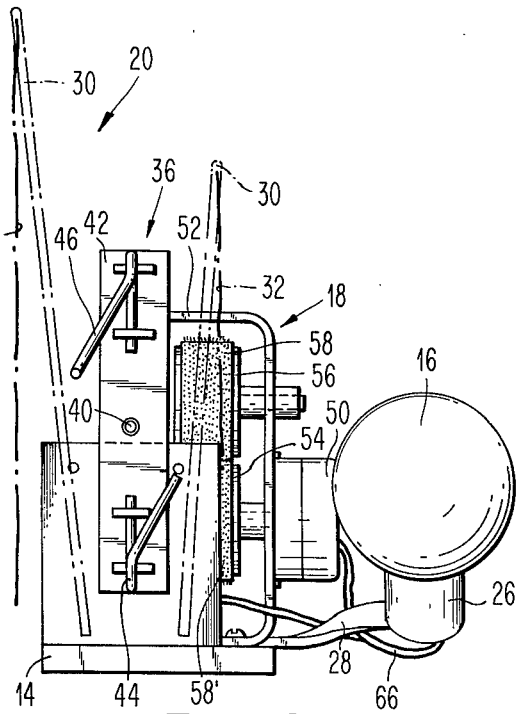
FIG. 6 is an enlarged detail view taken along reference line 6— of FIG. 4.
Figure 7:
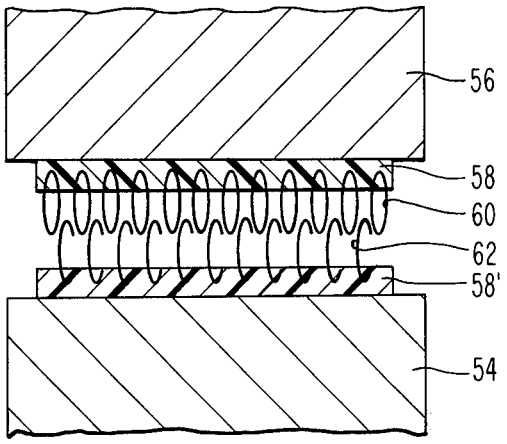
FIG. 7 is an enlarged detail view of a material used in the noise simulator of the invention, and, FIG. 8 is a front elevational view of an alternate, improved embodiment of the flicker simulator used in the burning log simulator of the present invention.

Frame 14 encloses the bottom, sides and rear of the simulator, with the rear wall or plate being removed in FIG. 2 for clarity of illustration. Light 16 is mounted in a socket 26 connected to the rear bottom of frame 14 by a bracket 28, as best seen in FIGS. 4—6. When energized, light 16 emits radiant energy some of which passes through portion 24.

Light source 16 is typically a reddish orange light bulb.

Flicker simulator 20 comprises a pair of support wires 30, 30' connected to a bracket, each wire holding curtains 32 and 34, respectively, which are agitated or moved by an agitator 36 rotated by a motor 38. Curtains 32 and 34 are made of materials having mirror like reflecting surfaces such as highly polished aluminum foil, Mylar, etc. and have a series of evenly spaced strips that hang freely and downwardly from support 30. Curtain 32 is located in front of curtain 34 and is shorter. Light source 16 is located between the curtains and portion 24. The strips of each curtain are as wide as the spacings between the strips.

In a typical embodiment the curtains are spaced 2 inches apart and the curtain strips are of Mylar, one quarter inch wide and spaced one quarter inch apart.

Agitator 36 comprises a shaft 40 driven by motor 38. A plate 42 is affixed to shaft 40 and is connected to two spaced rods 44 and 46 bent into serpentine shapes. When motor 38 is energized, rods 44 and 46, which are located between curtains 32 and 34, rotate and brush against the strips of the curtains causing them to move in a somewhat haphazard random manner. Light from source 16 passes onto and is reflected from the strips of the curtains before reaching portion 24 and, due to the movement of the strips, produces the sensation of a flickering fire. Rods 44 and 46 are offset with respect to one another to produce more agitation of the strips 34, 32, hence the appearance of a hotter fire. Motor 38 is preferably of a constant speed type that drives shaft 40 at about 60 r.p.m. Speeds approximately 60 r.p.m. produce a bouncing fire effect whereas slower speeds yield less desirable, more rhythmic, more artifical effects.

The burning logs simulator as thus far depicted is characterized in that the sensation of a fast burning, hot fire is produced throughout the entire face of the burning logs 22 via light transmitting central portion 24. There are various size flames with flickering of same in a non-rhythmic or sporadic fashion.

Sound simulator 18 comprises a constant speed motor 50 on a bracket 52 affixed to frame 14. Motor 50 is connected to and drives a drum 54. Mounted on bracket 52 above drum 54 is a driven, second drum 56 on an axle, the outer surfaces of both drums being covered by pieces 58 and 58' of a synthetic material such as Scotchmate hook and loop fasteners manufactured by 3M Company under U.S. Pat. No. 3,009,235. Piece 58' comprises a multiplicity of hooking elements 62 and piece 58 comprises a multiplicity of loops 60. Typically, the drums are of wood and the pieces 58, 58' stapled thereto. Fibers 60 and 62 are relatively stiff and are formed integrally in a sheet of woven fabric type. When pieces 58 and 58' are pressed together, the fibers thereof intermesh.

Pieces thus joined can be pulled apart and the act of separation causes the fibers to produce a unique noise. One aspect of the invention is the discovery that this unique noise simulates the sound of a fast burning fire.

Pieces 58' and 58 on drums 54 and 56 intermesh so that as the drums are rotated, the intermeshing and separation of the material produces the noise or sounds simulating those of a real fire. This noise in conjunction with the visual effects described above combine to simulate a hot, fast flickering pile of burning logs. However, quite obviously, such visual and aural simulators can be used separately. The sound thus generated is a function of the speed of separation. The size of drums 54 and 56 and the speed of motor 50 provide a speed of separation of about 1 inch per second. Other speeds can be used. The materials adhere and then are pulled apart, the motor speed being chosen to provide a snapping action and accompanying sound.

Free wheeling drum is mounted within a right-angled slot 60 having a lower engaging position and an upper disengaging position. When the sound simulator is in use the drum is positioned at the lower engaging position, but where no sound is desired the free wheeling drum is moved to the upper disengaged position.

Light 16 and motors 38 and 50 are preferably connected to a common electric cord 66 that, in turn, is connectible to a suitable electric source and switch (not shown) for selective energization thereof.

Figure 8:
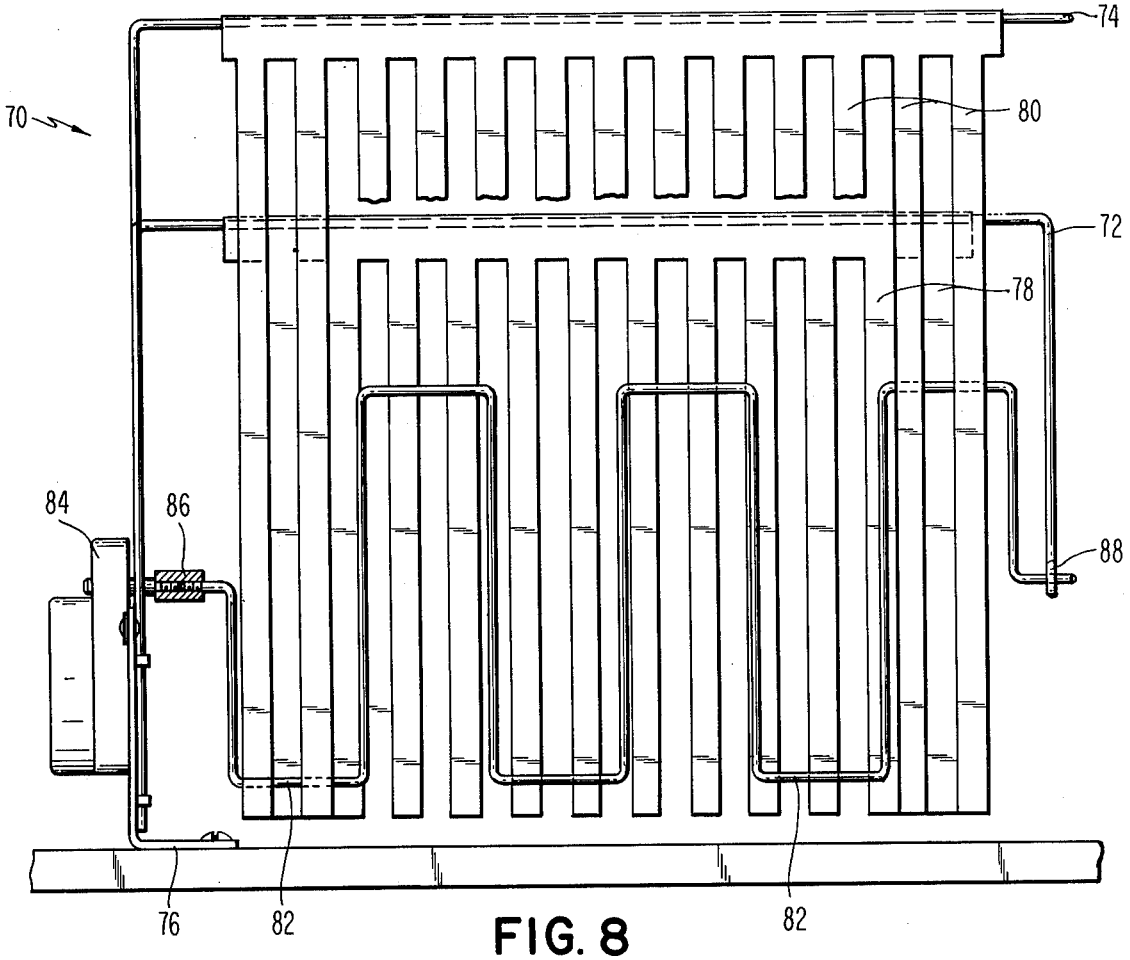

FIG. 8 depicts an alternate improved embodiment of a flicker simulator 70 to be used on the burning log simulator of the present invention. Simulator 70 includes support wires 72, 74 slidably held within bracket 76. Curtains 78, 80 are agitated or moved by an agitator 82 rotated by motor 84. It will be noted that agitator 82 comprises a one-piece wire having a threaded end operatively connected and supported within threaded tubing 86 and at the opposite end by a vertical looped extension 88 from support wire 72. The advantages of the improved flicker simulator 70 are readily apparent. Visually, in use, the appearance to an observer is the same. Cost of manufacture is substantially reduced. A single agitator 82 is employed. Support wires 72, 74 are slidably held within bracket 76 and are easily inserted into and removed from same. Thus curtains 78, 80 may be affixed to wires 72, 74 prior to insertion within bracket 76 and stored until needed. Finally, the need for one support bracket is eliminated.

It should be apparent to those skilled in the art that various changes by way of addition and omission and alterations can be made in the details and arrangement of parts without departing from the scope of the invention as defined in the appended claims.

What is claimed is:

1. A fire sound simulator comprising:
a first member;
a second member;
sound motive means for moving one of said members relative to the other;
looped material mounted on one of said members;
hooked material mounted on the other said members;
said members being juxtaposed to interengage said hooked and looped materials whereby said relative movement causes portions of said hooked and looped material to engage continuously whereby such engagement and disengagement produces sounds simulating those of a fire.

2. The invention defined by claim 1 wherein said members comprise rotary drums and said hooked and looped materials are mounted respectively on the circumferences of said drums.

3. The invention defined by claim 1 including means for moving one of said members from juxtaposition with said other of said members.

4. A burning log simulator comprising the combination of a visual burning log simulator and the fire sound simulator of claim 1.

5. The invention defined by claim 4 wherein said members comprise rotary drums and said hooked and looped materials are mounted respectively on the circumferences of said drums.

6. The invention defined by claim 4 including means for moving one of said members from juxtaposition with said other of said members.

7. A light flicker including:
a light source;
curtain means of two spaced curtains of downwardly depending strips of light reflecting material disposed adjacent said light source;
flicker motive means;
a serpentine rod means disposed between said curtain means for engaging said downwardly depending strips so as to mechanically agitate same upon rotation;
said rod means being supported from said curtain means at one end and being connected to said flicker motive means at one end and being connected to said flicker motive means for rotation at an opposite end whereby light from said light source reflected from said curtain strips upon agitation produces a light flickering sensation.

8. A burning log simulator comprising:
a burning log replica including a solid portion shaped like a pile of logs in the process of being burned, and a central translucent portion having a non-uniform surface shadowed black with white highlights to give a charring effect; and, the light flicker of claim 7 so positioned behind said burning log simulator such that light is reflected from said agitated curtain strips through said central translucent portion for producing visually the sensation of a flickering fire.

9. The invention defined by claim 8 including a fire sound simulator a first member;

a second member, sound motive means for moving one of said members relative to the other;

looped material mounted on one of said members;

hooked material mounted on the other of said members;

said members being juxtaposed to interengage said hooked and looped materials whereby said relative movement causes portions of said hooked and looped material to engage continuously whereby such engagement and disengagement produces sounds simulating those of a fire.

10. The invention defined by claim 9 wherein said members comprise rotary drums and said hooked and looped materials are mounted respectively on the circumferences of said drums.

11. The invention defined by claim 9 including means for moving one of said members from juxtaposition with said other of said members.

* * * * *